US008556080B2

(12) United States Patent
Sinclair et al.

(10) Patent No.: US 8,556,080 B2
(45) **Date of Patent: *Oct. 15, 2013**

(54) BOX/CARTON FOR SHIPPING FILTER CARTRIDGES

(75) Inventors: Jeffrey A. Sinclair, Clarksville, IN (US); LaMonte A. Crabtree, LaGrange, KY (US)

(73) Assignee: Clarcor Air Filtration Products, Inc., Jeffersonville, IN (US)

( * ) Notice: Subject to any disclaimer, the term of this patent is extended or adjusted under 35 U.S.C. 154(b) by 427 days.

This patent is subject to a terminal disclaimer.

(21) Appl. No.: 12/945,335

(22) Filed: Nov. 12, 2010

(65) Prior Publication Data

US 2011/0057022 A1 Mar. 10, 2011

Related U.S. Application Data

(63) Continuation-in-part of application No. 12/431,176, filed on Apr. 28, 2009.

(51) Int. Cl.
*B65D 43/16* (2006.01)

(52) U.S. Cl.
USPC ..... 206/738; 229/122

(58) Field of Classification Search
USPC ..... 229/122, 160.2, 126; 206/738
See application file for complete search history.

(56) References Cited

U.S. PATENT DOCUMENTS

| | | | | |
|---|---|---|---|---|
| 2,013,038 | A * | 9/1935 | Dollinger | 55/484 |
| 6,478,159 | B1 * | 11/2002 | Taylor et al. | 206/738 |
| 6,604,631 | B2 * | 8/2003 | Evans et al. | 206/320 |
| 7,036,716 | B2 * | 5/2006 | Kanamori et al. | 229/120.21 |
| 7,080,736 | B2 * | 7/2006 | Jackson et al. | 206/738 |
| 7,431,163 | B2 * | 10/2008 | Andersen | 206/736 |
| 7,451,878 | B2 * | 11/2008 | Rochefort et al. | 206/738 |
| 7,614,497 | B2 * | 11/2009 | Spivey, Sr. | 206/429 |
| 2004/0099558 | A1 * | 5/2004 | Oliff et al. | 206/427 |
| 2006/0144914 | A1 * | 7/2006 | Spivey, Sr. | 229/223 |
| 2010/0270204 | A1 | 10/2010 | Sinclair et al. | |

OTHER PUBLICATIONS

Pictures of box and statement supporting same, 13 pages.

* cited by examiner

*Primary Examiner* — Steven A. Reynolds
*Assistant Examiner* — King M Chu
(74) *Attorney, Agent, or Firm* — Reinhart Boerner Van Deuren P.C.

(57) ABSTRACT

A shipping and display carton is provided that may be used for panel filters. The carton preferably has three display positions including horizontally flat, vertically upright, and side filter display positions to provide a retailer with display options. The box has several features such as releasable interlocked retainer flaps to retain filters in one display position, perforated removal portions including a removable card carrying a cover lid, a single glue seam with interlocking bottom panels so as to provide break down without a cut knife, and other features.

16 Claims, 10 Drawing Sheets

BOX/CARTON FOR SHIPPING FILTER CARTRIDGES

CROSS-REFERENCE TO RELATED PATENT APPLICATIONS

This patent application is a Continuation-in-Part application of co-pending U.S. patent application Ser. No. 12/431,176, filed Apr. 28, 2009, the entire teachings and disclosure of which are incorporated herein by reference thereto.

FIELD OF THE INVENTION

The present invention generally relates to shipping and display cartons and/or cardboard blanks for forming a shipping and display carton; the shipping and display carton may be used with panel filters whereby one of the aspects of the invention relate to panel filters in combination with the shipping and display carton.

BACKGROUND OF THE INVENTION

Almost every home has a panel filter which is installed in a forced air system such as the furnace and/or air conditioning unit (the HVAC system) of one's house, condominium or apartment. Panel filters are also used in the HVAC systems of other commercial buildings. Over time, the panel filters load with dust as these filters purify and clean the air that is being circulated throughout the building. As a result, these panel filters need to be changed from time to time so as to provide a clean filter and not overly restrict the air flow being circulated through the building.

As a result, a number of retailers carry large volumes of such panel filters for retail sale. Furthermore, as there are many different sizes and types of furnaces, air conditioning units or other HVAC systems, retailers need to stock a wide variety of different sizes of panel filters to meet all of the different needs of different customers.

To display such panel filters, it is known to use shipping and display cartons wherein a stack of panel filters can be shipped in a cardboard box and then the box can be partially opened to display the panel filters right on the retail shelf. While previous shipping and display cartons have provided a certain level of functionality, they present various difficulties and/or drawbacks which will be realized once the embodiment of the present invention is understood. As such, the present invention is directed towards improvements over the present state of the art.

BRIEF SUMMARY OF THE INVENTION

In one inventive aspect, a filter packed shipping and display carton is provided, including a stack of panel filters having a rectangular frame enclosing filter media therein; and a box containing the stack of panel filters. The box includes opposed top and bottom sides, left and right sides, and back and front sides. A first side of the sides includes a pair of cooperating first and second retainer flaps hinged to and depending from two other of the sides. The first and second retainer flaps are locked together to retain the panel filters in a first display position through a first display opening in the first side. A second side of the sides, different from the first side, includes a removable side panel defined in the second side by perforations. The removable side panel, when removed, provides a viewing window through the second side to view at least a portion of the stack of panel filters.

In another inventive aspect, a filter packed shipping and display carton combination is provided including a stack of panel filters having a rectangular frame enclosing filter media therein and a box containing the stack of panel filters. The box includes opposed top and bottom sides, left and right sides and back and front sides. The top side includes a pair of cooperating first and second retainer flaps hinged to and depending from the left and right sides. The first and second retainer flaps are locked together to retain the panel filters in a first display position through a first display opening in the top side. In the first display position, the box displays the stack of panel filters with the panel filters vertically stacked one on top of another to display one of the spine edges of the rectangular frame for the panel filters. The at least one last filter viewing window is defined between the retainer flaps and the back side and includes at least one cut out along a lateral edge of the retainer flaps. The lateral edge runs along the back side and in close proximity thereto to prevent one of the panel filters from sliding out from under the retainer flaps when in the first display position. The retainer flaps are spaced from the front side at least two panel filters thick to provide a sufficiently large and open aperture in first display opening such that panel filters can be removed horizontally out through the first display opening. The first and second retainer flaps are adopted to releasably interlock together without any adhesive. The box also provides a lid panel for the top side. The lid panel is hinged to the front side and covers the first and second retainer flaps. The lid panel includes a lid body and a tuck tab, with the lid body interposed between the tuck tab and the front side. The tuck tab is hinged to the lid body. In a shipping position, the tuck tab is tucked between the stack of panel filters and the back side. A strip of tape is attached to the lid body and adhesively secures the lid panel to the back side. The strip of tape has a pull tab. A perforated tear line connects the lid panel to the front side such that the lid panel is adapted to be torn off along the perforated tear line to expose and provide for removal of panel filters through the first display opening. The lid panel is also adapted be reverse folded back over the front display panel to expose and provide for removal of panel filters through the first display opening. The front side comprises a front panel including a border portion at least partially lining and connected via fold lines to the left, right, and bottom sides, and a removable card connected to the border portion along a perforated tear junction. The removable card is tearable and removable along the perforated tear junction to provide a second display opening that intersects the first display opening at a corner between the front and top sides. The second display opening provides for a second display position in which the bottom side is at the gravitational bottom. The back side is at the gravitational bottom position in the first display position. The box is rotated 90 degrees between first and second display positions. The removable card carries the lid panel therewith. The lid panel is supported by the removable card in a cantilever manner such that removal of the removable card removes the lid panel therewith. Also included are perforated punch out tabs along the perforated tear junction. At least one of said left side and said right side comprises a removable side panel defined by perforations, the removable side panel being tearable and removable along the perforations to provide a third display opening. The third display opening provides for at least one of use in conjunction with the first or second display positions and a third display position different from the first and second display positions. The box is made of corrugated cardboard. One of the left and right panels has a gluing seam flap overlapping and permanently secured to the back side by an adhesive seam. The bottom side comprises four interlocking bottom flaps connected to the left, front, right and back sides, respectively, interlocking with each other without adhesive attachment to releasable secure the box together in an assembled state. The box can be broken down manually to a flat state by unlocking the four interlocking bottom flaps and bending the box along four corners connecting the left, front, right and back sides, without tools and without having to tear the box or overcome adhesive force.

Another invention aspect is directed toward a unitary cut cardboard blank for forming a shipping and display carton. A carton has a shipping configuration and a display configuration for display of panel filters including a stack of panel filters having a rectangular frame enclosing filter media therein and a box containing the stack of panel filters. In the shipping configuration, the box includes opposed top and bottom sides, left and right sides, and back and front sides. The box includes at least two of at least a portion of the top side defined by perforations being removable in the display configuration to define a display opening by which at least a portion of the stack of panel filters may be viewed through the top side, at least a portion of at least one of the left side and the right side defined by perforations is removable in the display configuration to define a display opening by which at least a portion of the stack of panel filters may be viewed through the at least one of the left side and the right side, and at least a portion of the front side defined by perforations is removable in the display configuration to define a display opening by which at least a portion of the stack of panel filters may be viewed through the front side.

In yet another inventive aspect, a unitary cut cardboard blank for forming a shipping and display carton is provided including a front side panel; a left side panel hinged via a fold line to the front side panel; a right side panel hinged via a fold line to the front side panel; a back side panel hinged via a fold line to one of the left and right side panels. One of the right and left and back side panels includes a gluing seam flap adapted to overlap and to be permanently secured to one of the other panels by an adhesive seam. The unitary cut cardboard blank includes at least two of the following: a removable card defined in the front side panel by a perforated tear junction, a removable lid panel hinged to one of the front side panel and the back side panel, and a removable side panel defined in one of the right side panel and the left side panel by a perforated tear line; wherein when the shipping and display carton is assembled, each of the removable card, removable lid panel, and removable side panel, are configured such that when removed each provides a window for viewing the contents of the carton.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
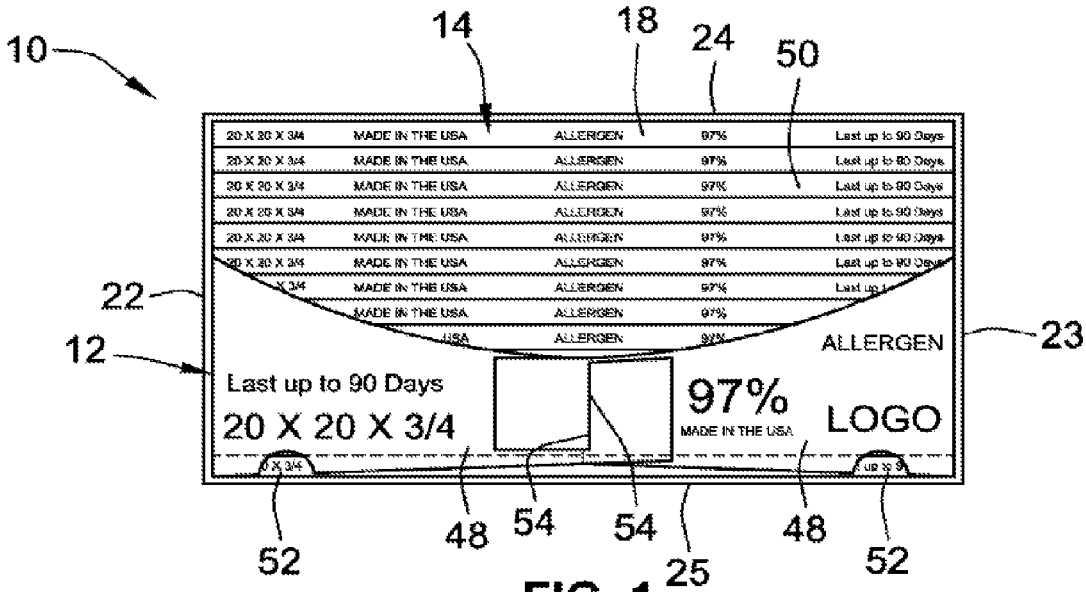
FIG. 1 is a frontal view of a filter packed shipping and display carton combination shown in a horizontally flat display position.
Figure 2:
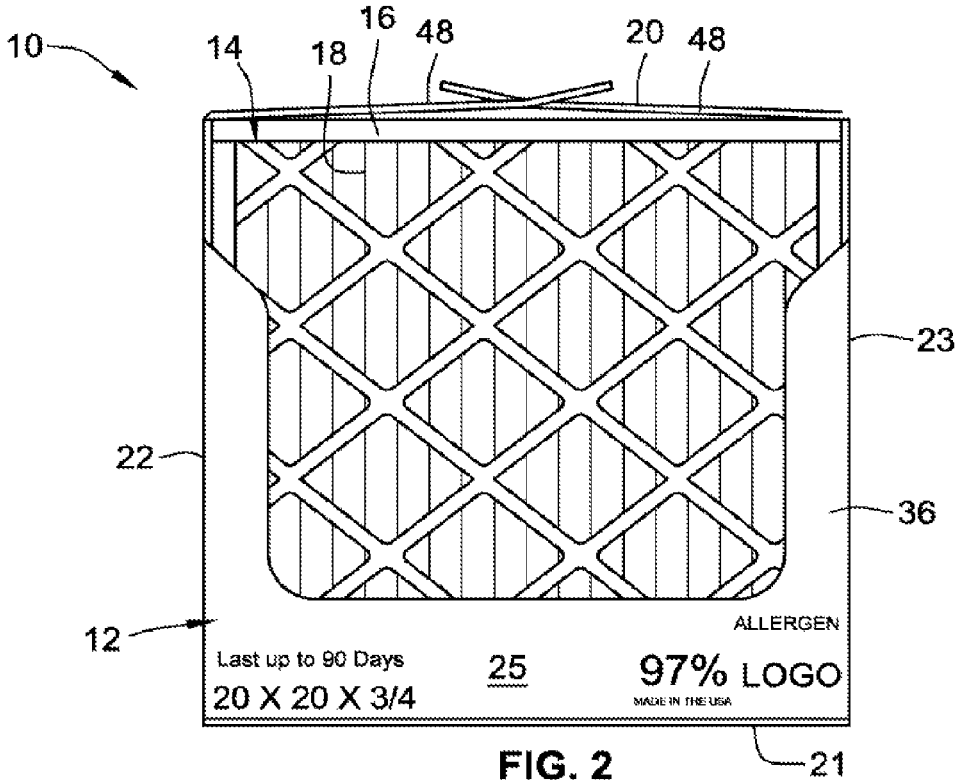
FIG. 2 is another view of the same filter packed shipping and display carton as shown in FIG. 1, but shown in a second vertically upright display position exposing a different surface for frontal view.

Referring to FIGS. 1 and 2, there is illustrated a filter packed shipping and display carton generally indicated at 10, both figures illustrated from a frontal view as would be displayed in a retail store on a shelf but shown in different display positions. The carton includes an assembled box 12 and a stack of panel filters 14 contained in the box 12.

In FIG. 1, the carton 10 is displayed in a horizontally flat position such that the edges or spines of the filter frames 16 of the panel filters 14 are illustrated. In contrast in FIG. 2, the carton 10 is illustrated in a vertically upright position so that one can view from the front the outline or boarder region of the filter frame 16 as well as the face of the panel filters 14 which includes filter media 18 that is boarded by the filter frame 16 (a marketing flyer sheet or other packaging may fully or partially enclose the panel filters); and it is noted that the filter media is shown as the pleated filter media. While both FIGS. 1 and 2 illustrate different frontal views of the same carton but in different positions, and therefore the terms top, bottom, left, right, front and back sides may change depending upon a relative position (e.g. in some situations the top may be a front side or other arrangement), for purposes of orientation and to provide the detailed description herein (without necessarily limiting the claims), it is understood that the relative orientation and positions will be described with reference to the vertical orientation listed for FIG. 2.

Figure 4:
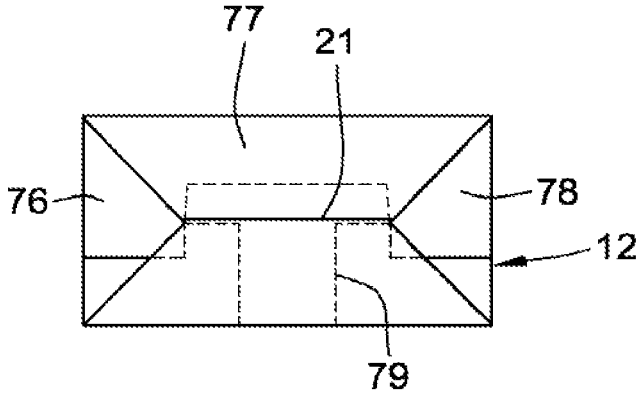
FIG. 4 is a bottom side view of the box which provides for the shipping and display carton.
Figure 5:
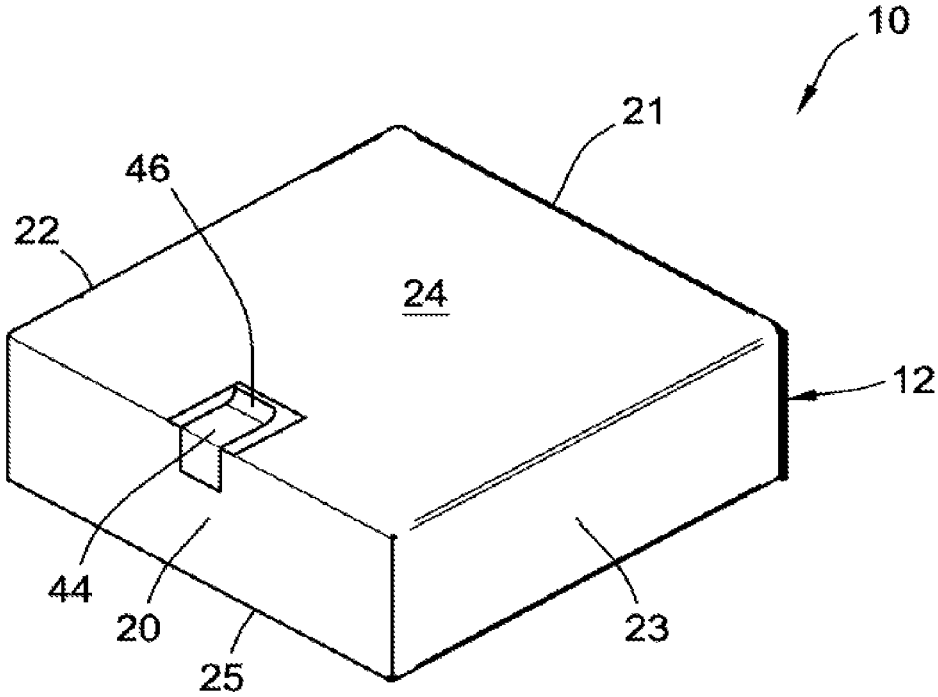
FIGS. 5 and 6 are additional isometric views of the shipping and display carton as viewed from opposite sides.
Figure 6:
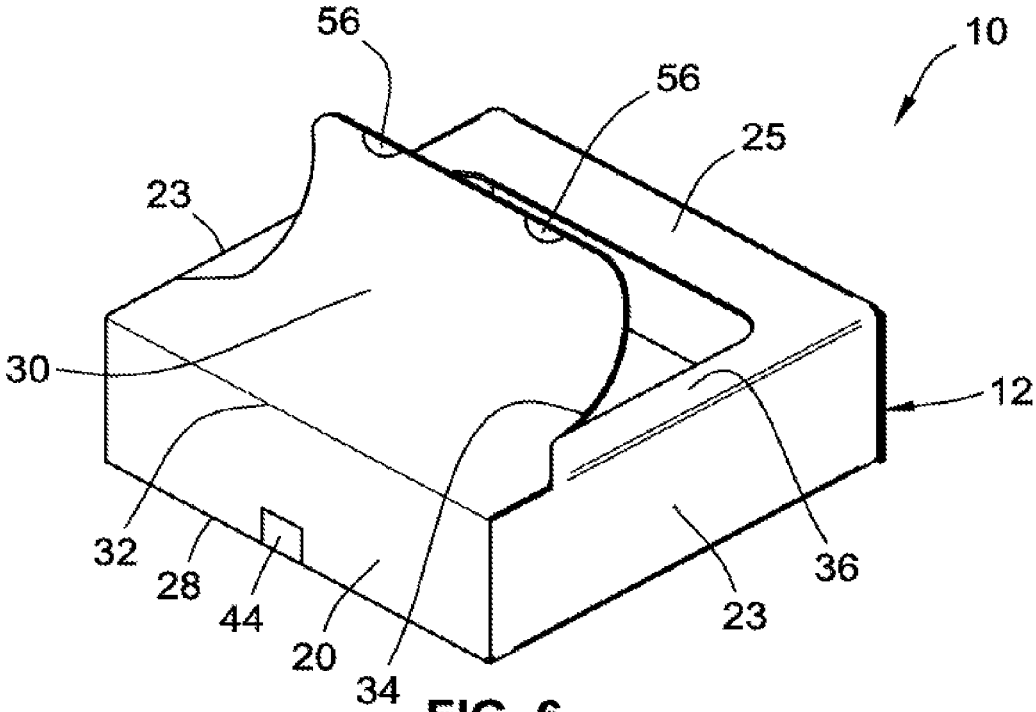

Therefore, to provide orientation purposes for FIG. 2 it is noted generally that the box has a plurality of sides including: a top side 20, a bottom side 21, a left side 22, a right side 23, a back side 24, and a front side 25 (for additional reference relative to the various sides, additional attention can be had to FIGS. 4-6). However as noted above, when the position changes for the box such as in FIG. 1 from FIG. 2, the top side 20 actually becomes a front side when in the frontal view shown for display purposes. Thus, as illustrated in FIGS. 1 and 2, at least two different display positions are possible, that gives a retailer options in how he wants to present panel filter merchandise to end-use customers. As also evident, the box 12 not only contains the panel filters 14 but also displays the panel filters such that the combination of the box and the panel filters are normally contained on the retail shelf itself.

As may be evidence from FIGS. 1 and 2, a portion of the box has been removed, such as may be provided by a perforated tear feature in the overall box structure. Specifically, and referring to FIG. 3 it is seen that a lid panel 28 and/or a removable card 30 can be removed from the overall box 12 along the top side 20 and front side 25. This facilitates both of the display positions shown in FIGS. 1 and 2. The lid panel 28 and the removable card 30 are connected by a perforated tear line 32 such that the lid panel 28 may be separately removed from the removable card with the removable card remaining with the remainder of the box. Thus, in the horizontally flat display position shown in FIG. 1, the removable card 30 may be removed from the box. Alternatively, in the display position shown in FIG. 1, the lid panel may be folded back upon the removable card 30 while still exposing the display opening.

Figure 3:
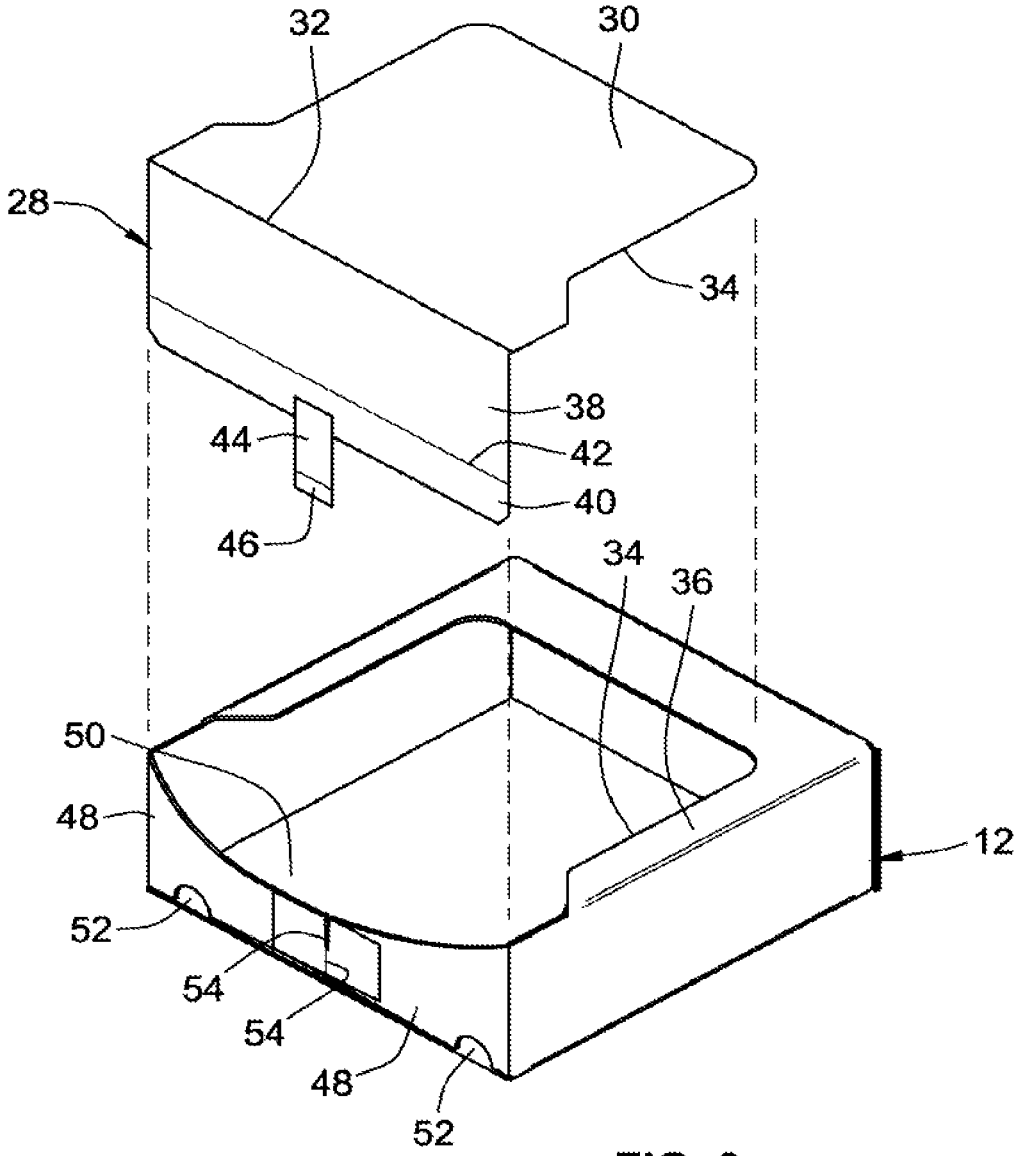
FIG. 3 is an exploded isometric view showing the removable component part of the shipping and display carton.

As shown, the removable card 30 carries the lid panel via the perforated tear line of the removable card by way of a perforated tear junction 34 connecting the removable card to a remainder border portion 36 along the front side. As also illustrated in FIG. 3 and FIG. 5, the lid panel 28 includes a lid body that covers the top end with a tuck tab 40 connected to the lid body by way of a hinge 42 such that the tuck tab may overlap the back side or otherwise be tucked beneath the back side. A strip of adhesive tape 44 may be used to removably secure the lid panel 28 to the remainder of the box, with the adhesive tape provided with a non-adhesive portion such as lift tab 46 to facilitate manually releasing the adhesive tape from the back side to facilitate opening and/or removal of the lid panel.

Once the lid panel 28 is removed, it is seen that underneath there is provided a pair of cooperating retainer flaps 48 that are releasably locked together to retain the panel filters along the top side. The retainer flaps 48 only partially cover the stack of filter panels and there is a display opening 50 provided above the retainer flaps 48 over the top of the retainer flaps when viewed from the front in the horizontally flat position. The retainer flaps 48 are spaced from the front side at least two panel filters thick to provide a sufficiently large and open aperture in the display opening 50 such that the panel filters can slide horizontally out through this display opening 50. Additionally, it is seen that at least one and preferably two last filter viewing windows 52 are defined between the retainer flaps 48 and the back side 24. For example, each viewing window 52 may be provided by at least one cut-out along the lateral edge of the retainer flaps 48 (preferably—the lateral edge runs along the back side and in close proximity thereto which prevents the panel filters from sliding out from under the retainer flaps when in the horizontally flat position shown in FIG. 1).

An additional feature that may be provided is that the retainer flaps 48 may each include respective slots 54 (one extending upward and the other extending downward in the horizontally flat position shown in FIG. 1), that are received into each other to thereby releasably interlock the first and second flaps together without the need for adhesive or glue. This facilitates more easy assembly and breakdown in that a cutting knife may not be necessitated according to certain preferred embodiments such as that disclosed in the drawings. Also, it should be pointed out while the retainer flaps 48 are interlocked over each other as shown in FIG. 2, they can also be tucked under each other, thereby hiding the terminal portion after the slots 54 under the other flap 48.

To facilitate removal of the removable card 30, perforated punch-out tabs 56 may be provided along the front side 25 to facilitate manually grasping and tearing the removable card 30 away from the remainder of the front side 25 of the box.

Figure 7:
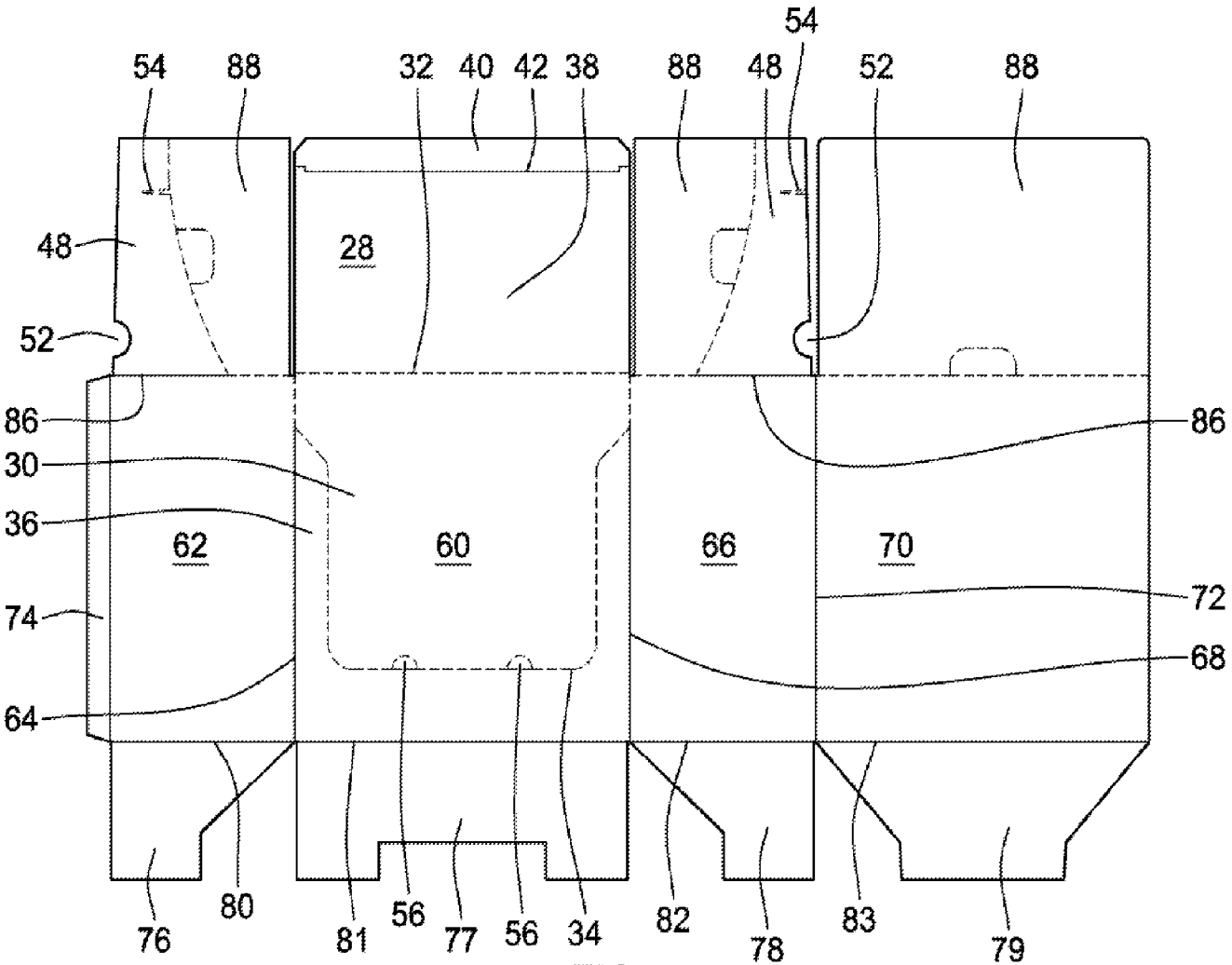
FIG. 7 is a plan view of a unitary cut cardboard blank according to an embodiment of the present invention for forming the shipping and display carton of the previous figures.
Figure 8:
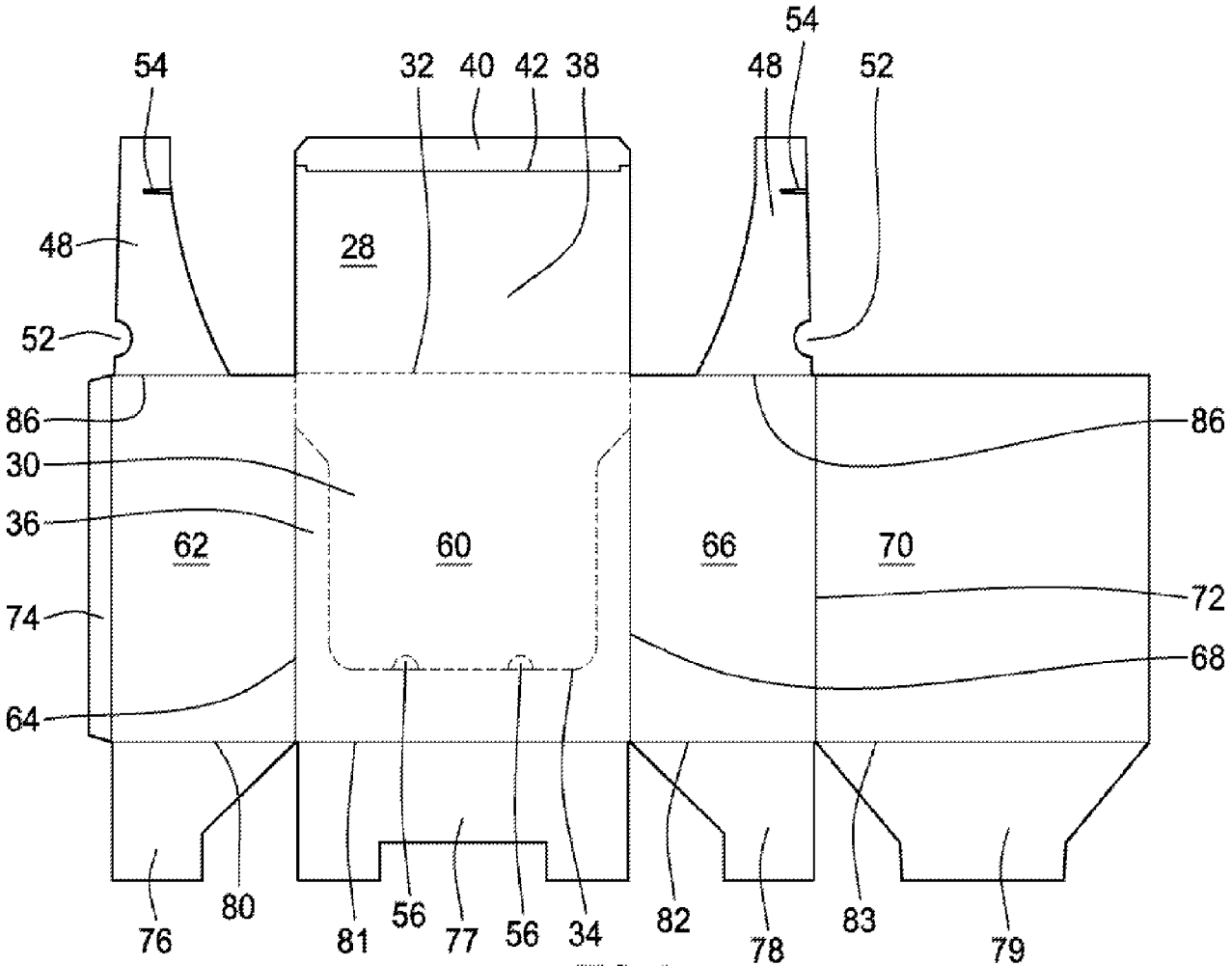
FIG. 8 is a similar plan view to that of FIG. 7 except that some of the removable panels have been removed to facilitate assembly.

All of these different perforation features and limited use of permanent adhesive provides for a box that can be made of corrugated cardboard as illustrated, and in which there is only a single strip of adhesive that permanently glues two portions of the box together. For example, and as shown in FIGS. 7 and 8, the box 12 can be constructed from a unitary cut cardboard blank, with only one gluing seam necessary along one line only to provide for a solid and sufficient shipping and display box that serves both purposes of shipping panel filters (with stackability capabilities without blowing out the box due to weight of filter packed boxes stacked on top) as well as displaying panel filters. This is both environmentally friendly but moreover and as will be discussed, provides for ready breakdown of the box without the need for cutting knives as the entire box may be disassembled by hand, providing substantial benefits and features to the retailer. For example, a unitary cardboard blank for forming the shipping and display carton may include a front side panel 60 for the front side; a left side panel 62 hinged via a fold line 64 to the front side panel; a right side panel 66 hinged via a fold line 68 to the front side panel 60; a back side panel 70 hinged via a fold line 72 to one of the left or right side panels 62, 66. It is then noted that one of the right and left and back side panels include a gluing seam flap (that is hinged to a remainder of that panel) that is adapted to overlap and be permanently secured to one of the other panels by an adhesive seam (e.g. a generally linear lay down of adhesive along the gluing seam flap 74).

Additionally, the bottom is constructed (such as shown in FIG. 4) such that it may not necessitate the need for adhesive and can be releasably secured together to facilitate breakdown. For example, the bottom side 21 may include at least three and preferably four interlocking bottom flaps 76, 77, 78, 79 that are hinged via respective fold lines 80-83 to the respective front, left, right and back side panels. The interlocking bottom flaps are adapted to interlock with each other without adhesive attachment to releasably secure the box together in an assembled state. The retainer flaps 48 are hinged to and depend from the left and right side panels 62, 66 via respective fold lines 86. The lid panel 28 is connected to the front side panel 60 via the perforated tear line 32 (note that dash lines indicate perforations in FIGS. 7 and 8). Additionally, the removable card 30 is formed into the front side panel 60 via the perforated tear juncture 34 surrounded by the border portion 36 of the front panel.

Additionally, in FIG. 7 there is illustrated a couple of additional waste panels that may be formed during the die cutting of the cardboard blank for the box but that are removed prior to assembly of the box including waste portions indicated at 88, that can be removed by their own perforated tear lines (not numbered).

With this construction, only a single glue seam connecting to adjacent panels is necessitated which allows the box to be broken flat by folding the front, left, right and back side panels (after unlocking the bottom flaps 76-79) by folding along the respective fold lines thereof. Thus, this can be done without the need for a knife.

Figure 9:
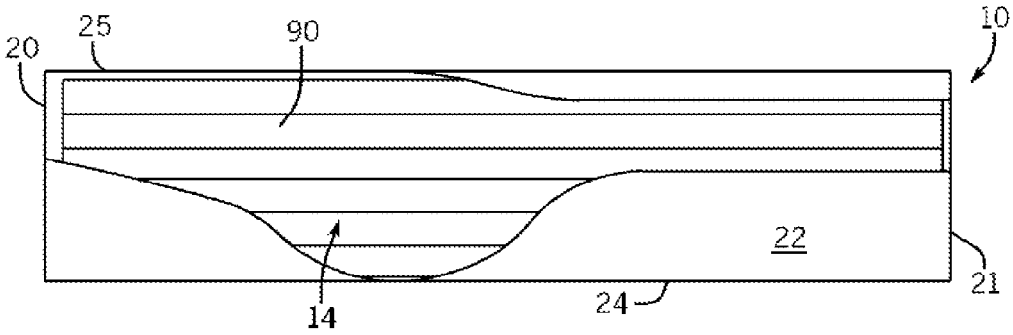
FIG. 9 is a side view of a second embodiment of a filter packed shipping and display carton combination with the side panel removed.
Figure 10:
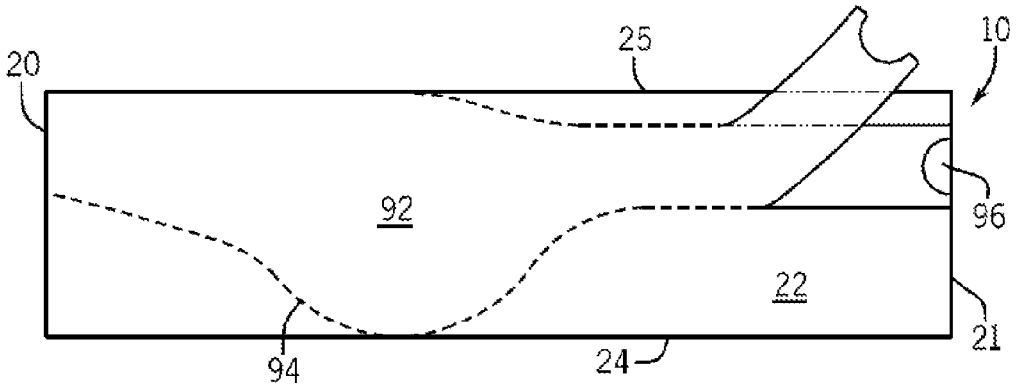
FIG. 10 is a side view of the filter packed shipping and display carton combination of FIG. 9 as the side panel is removed.
Figure 11:
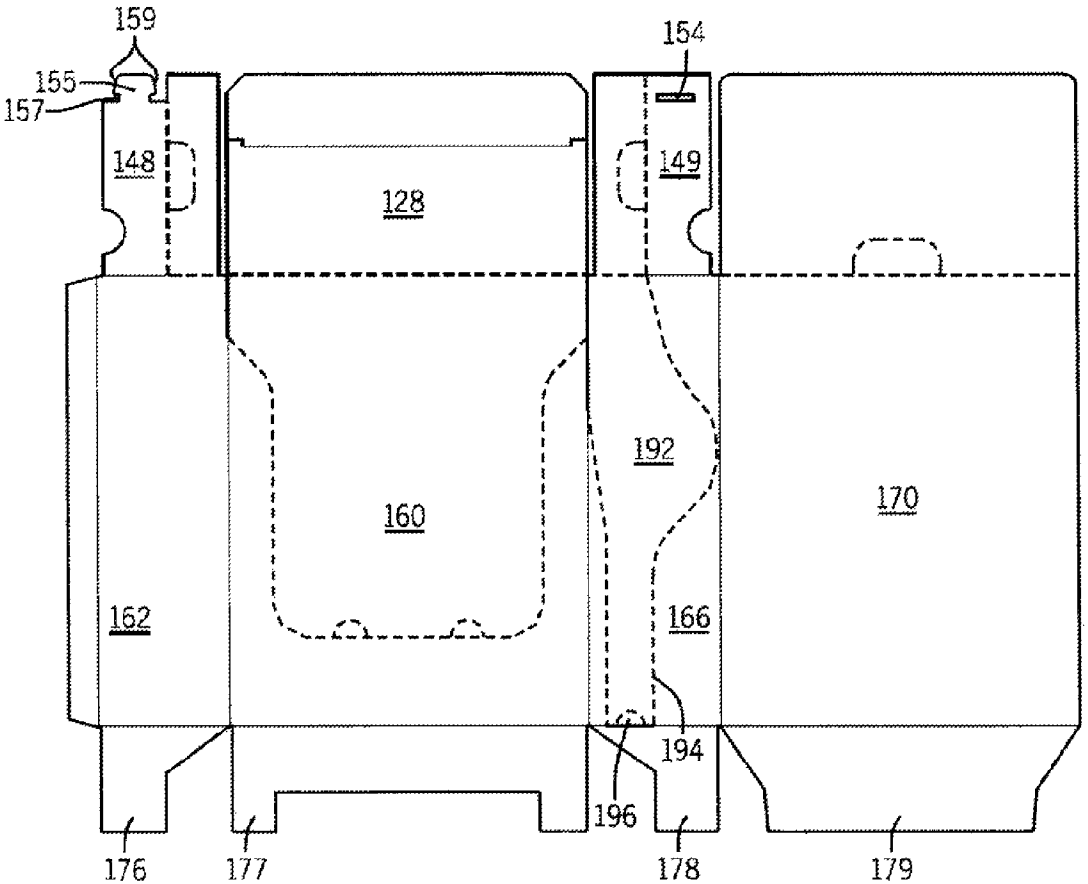
FIG. 11 is a plan view of a unitary cut cardboard blank according to a second embodiment of the present invention for forming the shipping and display carton of FIGS. 9 and 10.

With reference to FIGS. 9-11, an additional embodiment in accordance with the teachings of the present invention is illustrated. For purposes of this description, the additional embodiment illustrated is substantially similar to the previously described embodiments. Therefore, only features that are different from the previous embodiment will be described in detail. Additionally, similar features are labeled with similar reference numerals for easy reference.

As illustrated in FIGS. 9-11 a three-way quick display carton 110 is illustrated. In addition to the two display positions illustrated in the previous embodiment, horizontally flat and vertically upright, the three-way quick display carton 110 is configured to provide a third display position: side filter display. This feature allows the side of the stack of filters 114 to be displayed for a desirable shelf presence positions and to provide a retailer with additional display options.

With particular reference to FIGS. 9 and 10, the display carton 110 may be placed with the back side 124 on a shelf, another display device, the floor, etc. At least one of the left side 122 and the right side 123 (in the exemplary embodiment of FIGS. 9 and 10, the left side 122 is illustrated) include a side panel 192 defined by a perforated tear line 194 originating at a perforated punch out tab 196. A user may use the perforated punch out tab 196 to grasp and remove the side panel 192 along the perforated tear line 194. As the side panel 192 is removed, the stack of filters 114 may be viewed through the side display window 190 formed in the left side 122 (or the right side 124).

As is illustrated in FIG. 11, the three-way quick display carton 110 may also include a front side panel 160 and a lid panel 128, as in the previous embodiment, to allow for three different viewings of the stack of filters 114. When the carton 110 is displayed, all three panels 128, 160, 192 may be removed so that the stack of filters 114 may be viewed from three different directions, a combination of any two of the three panels may be removed, or a single panel may be removed leaving the other two panels in place depending on the desired shelf presence and display configuration selected by the retailer.

In one embodiment, when the display carton 110 is displayed with the front side panel 160 displayed outwardly towards a potential consumer, if the display carton 110 is located at the end of a shelf, the side panel 192 may be removed to reveal the stack of filters 114 through the side display window 190 as well, giving potential consumers dual viewing perspectives of the stack of filters 114. Additionally, when the display carton 110 is displayed with the top side 128 of the carton 110 displayed towards a potential consumer, again, the side panel 192 may be removed to reveal the stack of filters 114 through the side display window 190, again giving potential consumers dual viewing perspectives of the stack of filters 114. Both of these configurations may improve shelf presence over conventional cartons and may take advantage of viewing opportunities both from the front of the display shelf, as well as from the side.

Figure 11A:
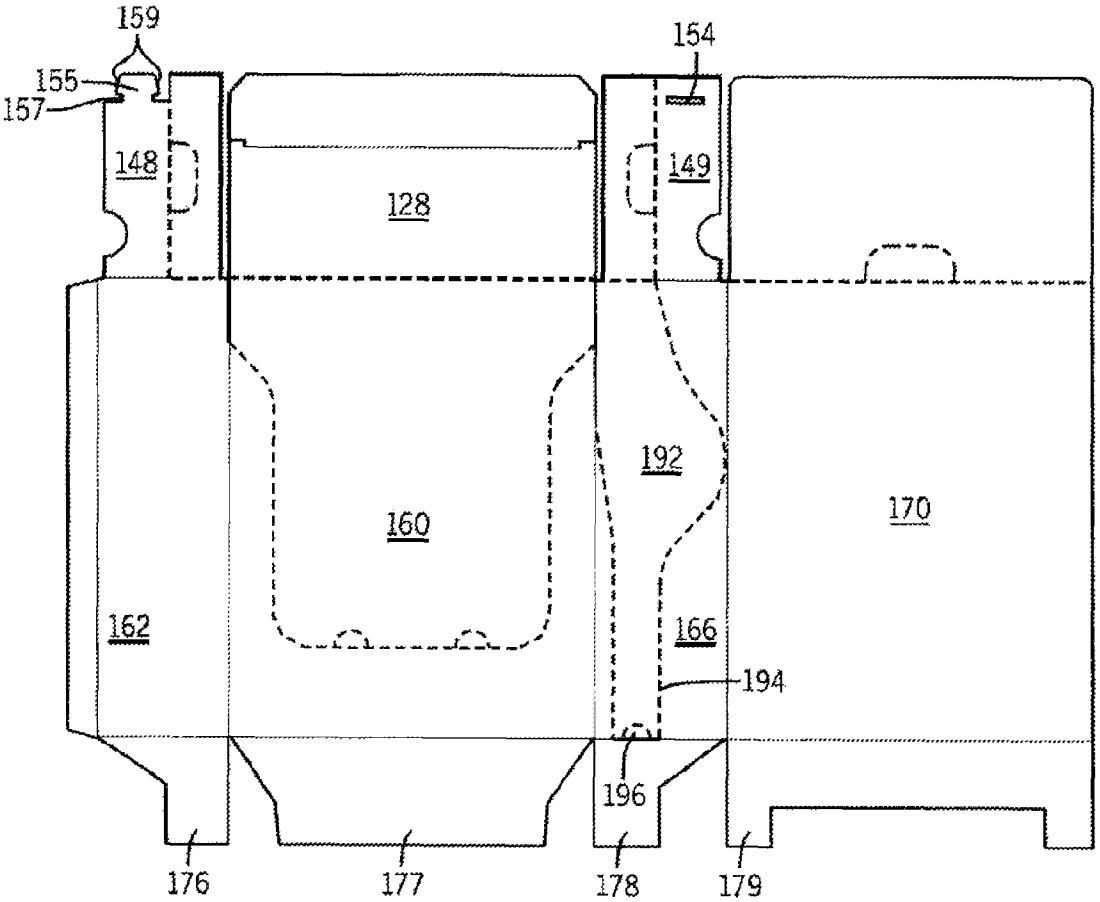
FIG. 11*a* is a plan view of a unitary cut cardboard blank according to an alternate embodiment of the present invention for forming a shipping and display carton.

Although in FIGS. 11 and 11*a* a side panel 192 is defined in the right side panel 166, a side panel 192 may be defined in either the left side panel 162 or in the right side panel 166. Additionally, removable side panels 192 may be defined in both the right side panel 166 and the left side panel 162.

Figure 12:
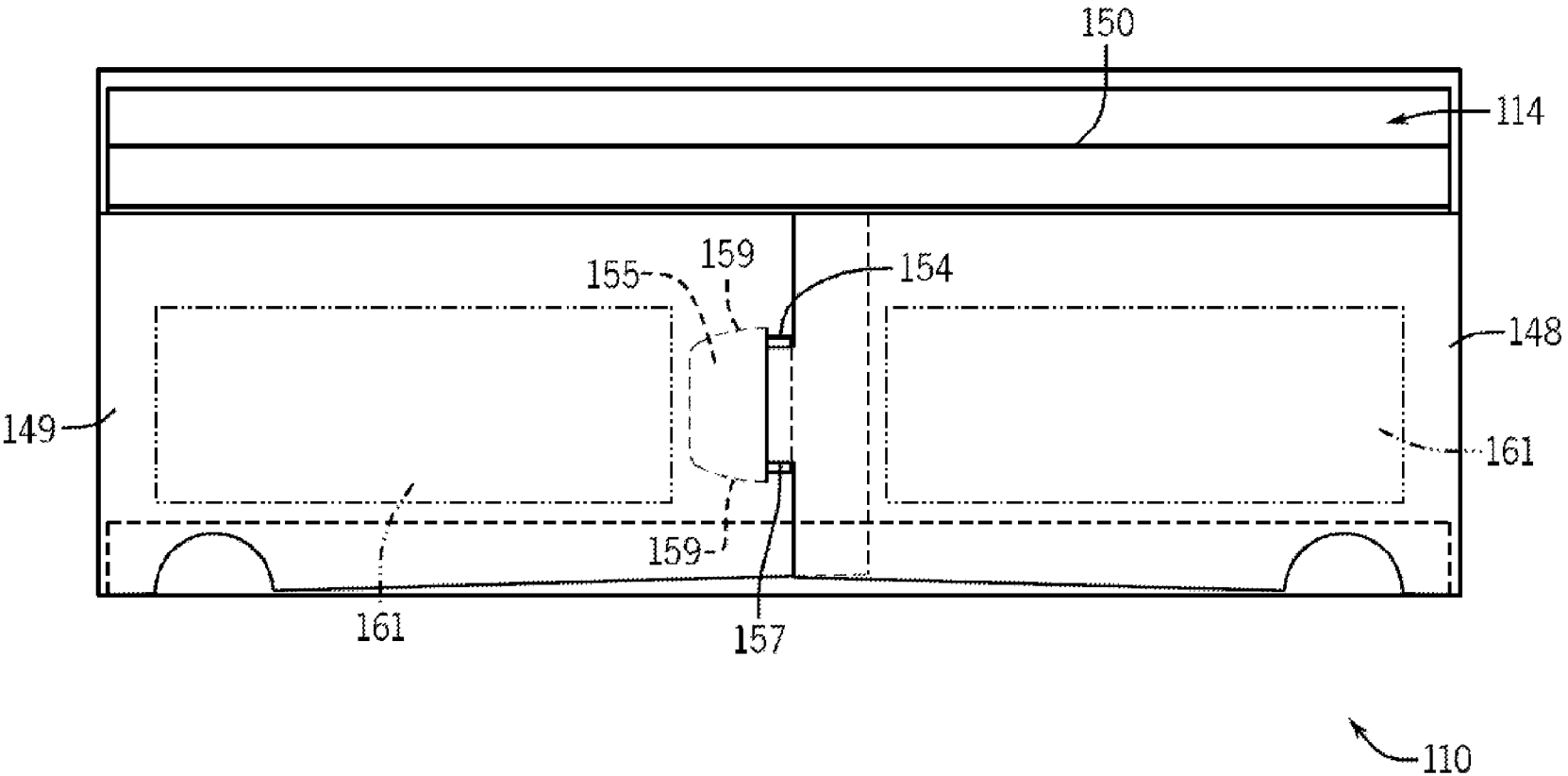
FIG. 12 is a frontal view of the second embodiment of the filter packed shipping and display carton combination of FIGS. 9 and 10 shown in a horizontally flat display position.

With reference to FIGS. 11 and 12, the second embodiment of the carton may include a second configuration of first and second retainer flaps 148, 149 that cooperatively interact to form a locking tab enclosure. The second retainer flap 149 defines a slot 154 proximate its end distal from the connection of the second retainer flap 149 to one of the side panels 162, 166. The first retainer flap 148 defines at its end distal from its connection to the other of the side panels 162, 166 a projecting tab 155 sized and configured to interface with the slot 154 to secure the first retainer flap 148 to the second retainer flap 149. The projecting tab 155 includes a slot retaining portion 157 defined by a pair of flaps 159. The flaps 159 may be wider than the slot 154. Thus, when the projecting tab 155 is inserted into the slot 154 the slot 154 may be seated in the slot retaining portion 157 and prevented from withdrawing from around the projecting tab 155 by the flaps 159 which may extend beyond the width of the slot 154.

Although the projecting tab 155 is illustrated as located on the first retainer flap 148 and the slot 154 is illustrated as defined in the second retainer flap 149, these may be reversed. As is illustrated in FIG. 12, the projecting tab 155, when engaged with the slot 154 may be configured behind the second retainer flap 149. Additionally, it is also contemplated that the projecting tab 155 may be configured in front of the second retainer flap 149.

Additionally, FIG. 11*a* illustrates an alternate embodiment of a unitary cut cardboard blank generally similar to the blank of FIG. 11, however providing alternate interlocking bottom flaps 176, 177, 178, 179. As in the bottom flaps of the previous embodiment 76, 77, 78, 79, 176, 177, 178, 179, the unitary cut cardboard blank is constructed such that it may not necessitate the need for adhesive and can be releasably secured together to facilitate breakdown. The interlocking bottom flaps are adapted to interlock with each other without adhesive attachment to releasably secure the box together in an assembled state. One having ordinary skill in the art will recognize that various suitable configurations of bottom flaps are possible, and various suitable configurations of bottom flaps known in the art are contemplated for use in embodiments of the present invention.

Again with reference to FIG. 12, the retainer flaps 148, 149 may include advertising or other indicia 161 printed on or adhered to each of the flaps 148, 149. The indicia 161 on each flap 148, 149 may cooperate with the indicia on the other flap 148, 149 to form a single coherent message or may be separate and distinct. Thus, when the lid panel 128 is removed or folded back, the retainer flaps 148, 149 may cooperate both to prevent the stack of filters 114 from unintended withdrawal from the carton 110, while still allowing the stack of filters 114 to be seen through the display opening 150, and, additionally, to provide consumers with easily seen information in the form of the indicia 161 directly below the display opening 150 and within easy view. The indicia 161 may include advertisement information, important product performance information, relevant consumer marketing information, or any other suitable information, pictures, or words, including information to help a consumer identify and better understand the benefits of the product. The retainer flaps 148, 149 may be similar to the retainer flaps 48 of the previous embodiment in other aspects as described above.

The display opening 150 in the embodiment illustrated in FIG. 12 is configured above the flaps 148, 149 in a top feed configuration, allowing for withdrawal of panel filters through the display opening 150 above the flaps 148, 149.

Figure 13:
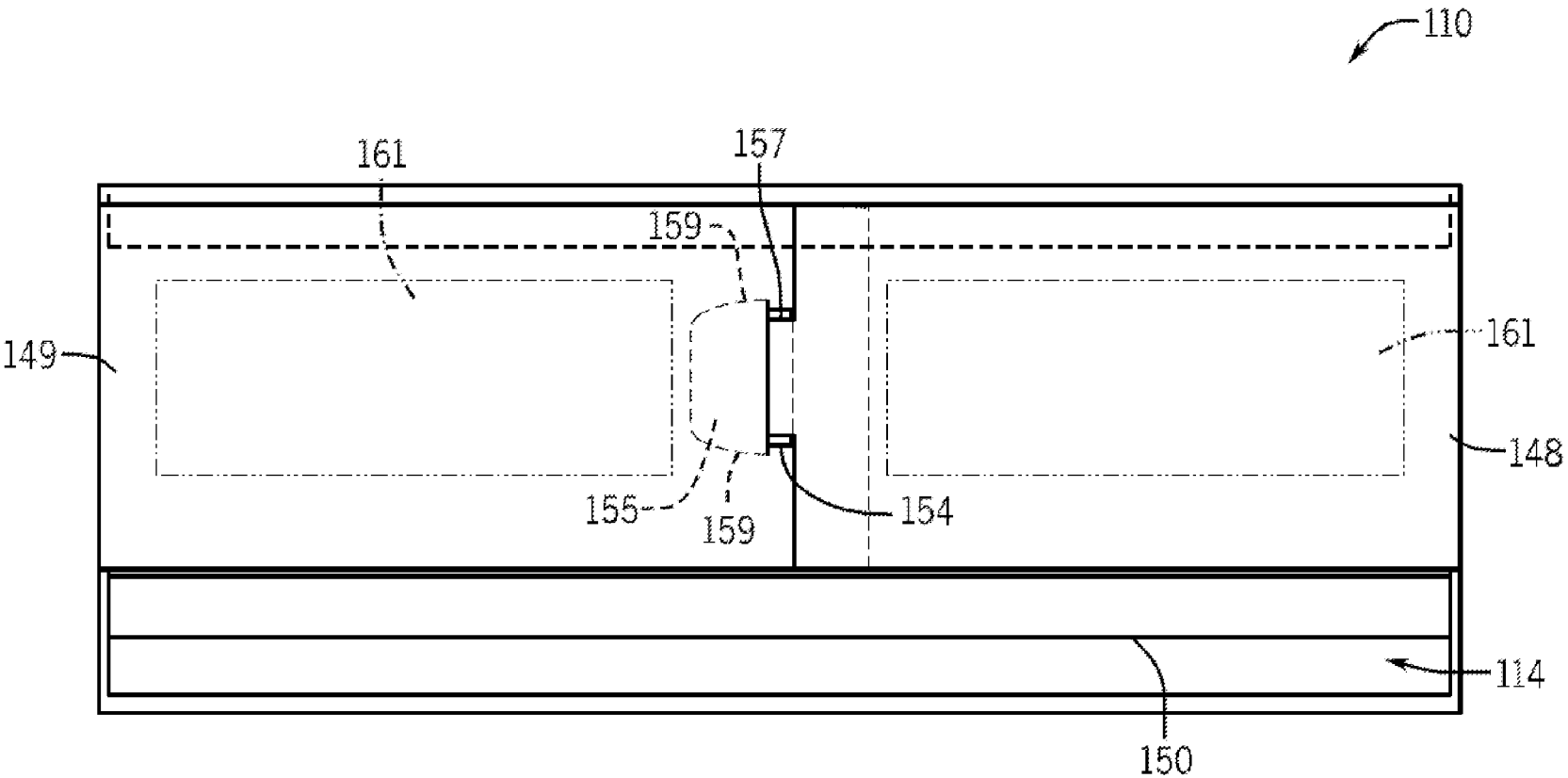
FIG. 13 is a frontal view of an additional embodiment of a filter packed shipping and display carton shown in a horizontally flat display position.

In another embodiment, as illustrated in FIG. 13, the flaps 148, 149 may be configured to provide the display opening 150 below the flaps 148, 149 in a bottom feed configuration. The flaps 148, 149 engage in a similar manner to the previous embodiment, however the flaps 148, 149 are configured to define the display opening 150 below the flaps, thus allowing for withdrawal of panel filters through the display opening 150 below the flaps. The retainer flaps 148, 149 may be similar to the retainer flaps 148, 149 of the previous embodiment in other aspects as described above. Additionally, display openings 150 of various suitable sizes are also contemplated, allowing for different numbers of panel filters in the stack of panel filters 114 to be seen through the display opening 150 by a consumer.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A filter packed shipping and display carton combination, comprising:

a stack of panel filters, the panel filters having a rectangular frame enclosing filter media therein;

a box containing the stack of panel filters, the box including opposed top and bottom sides, left and right sides and back and front sides, the top side including a pair of cooperating first and second retainer flaps hinged to and depending from the left and right sides, the first and second retainer flaps being locked together to retain the panel filters in a first display position through a first display opening in the top side;

wherein in the first display position, the box displays the stack of panel filters with the panel filters vertically stacked one on top of another to display one of the spine edges of the rectangular frame for the panel filters;

wherein the at least one last filter viewing window is defined between the retainer flaps and the back side;

wherein the at least one last filter viewing window comprises at least one cut out along a lateral edge of the retainer flaps, the lateral edge running along the back side and in close proximity thereto to prevent one of the panel filters from sliding out from under the retainer flaps when in the first display position;

wherein the retainer flaps are spaced from the front side at least two panel filters thick to provide a sufficiently large and open aperture in first display opening such that panel filters can be removed horizontally out through the first display opening;

wherein the first and second retainer flaps are adopted to releasably interlock together;

wherein the retainer flaps are releasably interlocked without any adhesive;

a lid panel for the top side, the lid panel hinged to the front side and covering the first and second retainer flaps;

wherein the lid panel includes a lid body and a tuck tab, the lid body interposed between the tuck tab and the front side, the tuck tab hinged to the lid body and in a shipping position being tucked between the stack of panel filters and the back side;

a strip of tape attached to the lid body and adhesively securing the lid panel to the back side, the strip of tape having pull tab;

a perforated tear line connecting the lid panel to the front side, wherein the lid panel is adapted to be torn off along the perforated tear line to expose and provide for removal of panel filters through the first display opening, and wherein the lid panel is also adapted be reverse folded back over the front display panel to expose and provide for removal of panel filters through the first display opening;

wherein the front side comprises a front panel including a border portion at least partially lining and connected via fold lines to the left, right, and bottom sides, and a removable card connected to the border portion along a perforated tear junction, the removable card being tearable and removable along the perforated tear junction to provide a second display opening that intersects the first display opening at a corner between the front and top sides;

wherein the second display opening provides for a second display position, the bottom side being at the gravitational bottom in the second display position, and wherein the back side being at the gravitational bottom position in the first display position, the box being rotated 90 degrees between first and second display positions;

wherein the removable card carries the lid panel therewith, the lid panel supported by the removable card in a cantilever manner such that removal of the removable card removes the lid panel therewith;

perforated punch out tabs along the perforated tear junction;

wherein at least one of the left side and the right side comprises a removable side panel defined by perforations, the removable side panel being tearable and removable along the perforations to provide a third display opening;

wherein the third display opening provides for at least one of use in conjunction with the first or second display positions and a third display position different from the first and second display positions; and wherein the box is made of corrugated cardboard, one of the left and right panels having a gluing seam flap overlapping and permanently secured to the back side by an adhesive seam, and wherein the bottom side comprises four interlocking bottom flaps connected to the left, front, right and back sides, respectively, the interlocking bottom flaps interlocking with each other without adhesive attachment to releasable secure the box together in an assembled state, and wherein the box can be broken down manually to a flat state by unlocking the four interlocking bottom flaps and bending the box along four corners connecting the left, front, right and back sides, without tools and without having to tear the box or overcome adhesive force.

2. The carton of claim 1, wherein the first retainer flap defines a slot, the second retainer flap includes a projecting tab, the projecting tab includes a portion larger than the slot and a slot retaining portion at least as small as the slot, such that the slot will tend to remain in the slot retaining portion upon insertion of the projecting tab through the slot thereby joining the first retainer flap and the second retainer flap to retain the panel filters in a first display position through a first display opening in the first side.

3. The carton of claim 1, wherein the first and second retainer flaps each define respective slots, the respective slots of the first and second retainer flaps being received into each other thereby releasably interlocking the first and second flaps together.

4. A carton having a shipping configuration and a display configuration for display of panel filters comprising:

a stack of panel filters, the panel filters having a rectangular frame enclosing filter media therein;

a box containing the stack of panel filters, the box in the shipping configuration including opposed top and bottom sides, left and right sides, and back and front sides;

wherein the box includes at least two of:

at least a portion of the top side in the display configuration may be displaced to define a display opening by which at least a portion of the stack of panel filters may be viewed through the top side;

at least a portion of at least one of the left side and the right side defined by perforations is removable in the display configuration to define a display opening by which at least a portion of the stack of panel filters may be viewed through the at least one of the left side and the right side; and at least a portion of the front side defined by perforations is removable in the display configuration to define a display opening by which at least a portion of the stack of panel filters may be viewed through the front side; and wherein the top side includes a body portion and a tuck tab hinged to the body portion along a fold line, and wherein the removable portion of the top side is carried by the removable portion of the front side in a cantilever manner;

wherein removal of the removable portion of the front side by tearing along the perforations removes the removable portion of the top side therewith.

5. The carton of claim 4, further comprising a pair of cooperating first and second retainer flaps hinged to and depending the left and right sides respectively, the first and second retainer flaps being locked together to retain the panel filters in the display configuration when the portion of the top side defined by perforations is removed.

6. The carton of claim 4, wherein the box is made of corrugated cardboard with two of the sides being connected by an adhesive seam, wherein the bottom side comprises at least three interlocking bottom flaps connected to at least three of the left, front, right and back sides, the interlocking bottom flaps interlocking with each other without adhesive attachment to releasable secure the box together in an assembled state, and wherein the box can be broken down manually to a flat state by unlocking the at least three interlocking bottom flaps and bending the box along four corners connecting the left, front, right and back sides, without tools and without having to tear the box or overcome adhesive force.

7. The carton of claim 4, wherein both of the left side and the right side include at least a portion defined by perforations removable in the display configuration to define a display opening by which at least a portion of the stack of panel filters may be viewed through the at left side and the right side.

8. The carton of claim 4, wherein the box includes all of:

at least a portion of the top side defined by perforations is removable in the display configuration to define a display opening by which at least a portion of the stack of panel filters may be viewed through the top side;

at least a portion of at least one of the left side and the right side defined by perforations is removable in the display configuration to define a display opening by which at least a portion of the stack of panel filters may be viewed through the at least one of the left side and the right side; and at least a portion of the front side defined by perforations is removable in the display configuration to define a display opening by which at least a portion of the stack of panel filters may be viewed through the front side.

9. The carton of claim 4, wherein the bottom side comprises at least three interlocking bottom flaps connected to at least three of the left, front, right and back sides, the interlocking bottom flaps interlocking with each other without adhesive attachment to releasable secure the box together in an assembled state, and wherein the box can be broken down manually to a flat state by unlocking the at least three interlocking bottom flaps and bending the box along four corners connecting the left, front, right and back sides, without tools and without having to tear the box or overcome adhesive force.

10. The carton of claim 4, further comprising a first retainer flap and a second retainer flap configured on the top side, the first retainer flap defining a slot, the second retainer flap including a projecting tab, the projecting tab including a portion larger than the slot and a slot retaining portion at least as small as the slot, such that the slot will tend to remain in the slot retaining portion upon insertion of the projecting tab through the slot thereby joining the first retainer flap and the second retainer flap to retain the panel filters in a first display position through a first display opening in the first side.

11. A unitary cut cardboard blank for forming a shipping and display carton, comprising:

a front side panel;

a left side panel hinged via a fold line to the front side panel;

a right side panel hinged via a fold line to the front side panel;

a back side panel hinged via a fold line to one of the left and right side panels;

one of the right and left and back side panels including a gluing seam flap adapted to overlap and to be permanently secured to one of the other panels by an adhesive seam, the unitary cut cardboard blank including at least two of the following:

a removable card defined in the front side panel by a perforated tear junction;

a removable lid panel hinged to one of the front side panel and the back side panel; and a removable side panel defined in one of the right side panel and the left side panel by a perforated tear line;

wherein when the shipping and display carton is assembled, each of the removable card, removable lid panel, and removable side panel, are configured such that when removed each provides a window for viewing the contents of the carton; and wherein the lid panel is carried by the removable card portion in a cantilever manner wherein removal of the removable card portion by tearing along the perforated tear juncture removes the lid panel therewith.

12. The unitary cut cardboard blank of claim 11, further comprising first and second retainer flaps hinged to and depending from the left and right side panels, respectively;

wherein the first and second retainer flaps are adapted to releasably interlock together in an assembled state; and wherein the lid panel is adapted to cover the first and second retainer flaps.

13. The unitary cut cardboard blank of claim 11, wherein the blank includes all three of the removable card, removable lid panel, and removable side panel.

14. The unitary cut cardboard blank of claim 13, wherein the blank comprises a removable side panel defined in the left side panel by a perforated tear line and a removable side panel defined in the right side panel by a perforated tear line.

15. The combination of claim 12, wherein the first and second retainer flaps each define respective slots, the respective slots of the first and second retainer flaps being received into each other thereby releasably interlocking the first and second flaps together.

16. The combination of claim 12, wherein the first and second retainer flaps are hinged to and depending from two other of the sides;

wherein the first retainer flap defines a slot, the second retainer flap includes a projecting tab, the projecting tab includes a portion larger than the slot and a slot retaining portion at least as small as the slot;

wherein the slot will tend to remain in the slot retaining portion upon insertion of the projecting tab through the slot thereby joining the first retainer flap and the second retainer flap to retain the panel filters in a first display position; and wherein the retainer flaps are sized and configured such that a portion of the stack of panel filters is visible through the top side at least one of above and below the retainer flaps.

* * * * *

UNITED STATES PATENT AND TRADEMARK OFFICE

CERTIFICATE OF CORRECTION

PATENT NO. : 8,556,080 B2
APPLICATION NO. : 12/945335
DATED : October 15, 2013
INVENTOR(S) : Jeffrey A. Sinclair et al.

It is certified that error appears in the above-identified patent and that said Letters Patent is hereby corrected as shown below:

In the Specifications

In column 2, line 25, the word "adopted" should be replaced with -- adapted --.

In the Claims

Claim 1, column 10, line 14, the word "adopted" should be replaced with -- adapted --.

Signed and Sealed this
Seventeenth Day of December, 2013

Margaret A. Focarino

Margaret A. Focarino
*Commissioner for Patents of the United States Patent and Trademark Office*